US005944207A

United States Patent [19]

Reidenbach

[11] Patent Number: 5,944,207

[45] Date of Patent: Aug. 31, 1999

[54] BOTTLE CLOSURE ASSEMBLY

[76] Inventor: Bryan L. Reidenbach, 26 Northern Dr., Millersburg, Ohio 44654

[21] Appl. No.: 08/549,950

[22] Filed: Oct. 30, 1995

[51] Int. Cl.[6] ..... B65D 39/08; B65D 55/16

[52] U.S. Cl. ..... 215/243; 215/237; 215/306; 215/329

[58] Field of Search ..... 215/306, 206, 215/221, 235, 258, 218, 330, 334, 335, 336, 339, 243, 237, 250, 252, 329; 220/255, 256, 259, 290, 288, 291, 292, 276, 217, 223

[56] References Cited

U.S. PATENT DOCUMENTS

| | | | |
|---|---|---|---|
| 1,506,199 | 8/1924 | Pearson | 220/290 |
| 1,592,147 | 7/1926 | Mletschnig | 215/330 |
| 2,191,361 | 3/1940 | McDonald | 220/291 |
| 2,961,119 | 11/1960 | Leach | 215/306 X |
| 3,235,117 | 2/1966 | Mason, Jr. | 215/306 X |
| 3,514,003 | 5/1970 | Fitzgerald | 215/220 |
| 3,630,403 | 12/1971 | Berg | 215/220 |
| 4,043,475 | 8/1977 | Wheeler . | |
| 4,129,226 | 12/1978 | Percival | 215/235 |
| 4,289,248 | 9/1981 | Lynn | 215/330 |
| 4,485,934 | 12/1984 | Maguire . | |
| 5,040,691 | 8/1991 | Hayes et al. . | |
| 5,215,204 | 6/1993 | Beck et al. . | |
| 5,224,615 | 7/1993 | Hickerson | 215/330 X |

FOREIGN PATENT DOCUMENTS

| | | | |
|---|---|---|---|
| 1020543 | 2/1953 | France | 220/291 |
| 1272310 | 8/1961 | France | 220/291 |
| 135729 | 12/1919 | United Kingdom | 220/291 |

*Primary Examiner*—Stephen Castellano
*Assistant Examiner*—Niki M. Eloshway
*Attorney, Agent, or Firm*—Sand & Sebolt

[57] ABSTRACT

A bottle closure assembly for providing access to the fluids within a bottle without the complete removal of the closure. The bottle closure apparatus comprising a cap and a sleeve connected by a hinge. Both the cap and the sleeve containing internal threads for twisting the closure apparatus onto a threaded bottle opening. The closure sealing the container when fully threaded on to the threaded opening, while providing access to the fluid therein when only partially threaded (sleeve only) by allowing the cap to pivot about the hinge. In addition, position nubs may be provided along the threads to resistively indicate when the cap is pivotable.

6 Claims, 3 Drawing Sheets

BOTTLE CLOSURE ASSEMBLY

BACKGROUND OF THE INVENTION

1. Technical Field

The subject invention is generally directed to a closure for a container. More particularly, the invention relates to threaded closures for containers. Specifically, the invention relates to a closure for providing access to the contents of a container without the necessity of completely removing the entire closure and thereby subjecting the closure to loss or damage.

2. Background Information

Various containers for storing and transporting fluids such as water have been known and used for thousands of years. Prior to modern times, water containers were a necessity since homes and businesses did not have running water and therefore containers were needed to transport water from the local well to each house or business.

Many closures for containers have been developed including lids, corks, snap-on caps, and screw caps. Since man's discovery that fluids could be stored within containers for later use, new and better means for closing, sealing, or otherwise controlling fluid flow into and out of the container have been sought.

More recently, i.e., over approximately the past one hundred years, a phenomenal growth in the distribution of bottled beverages has occurred. The storage of beverages such as milk, water, juices, carbonated beverages, iced tea, and alcoholic beverages in containers such as cartons, bottles, flasks or jugs made from paper, plastic, or glass has flourished. Specifically, these various containers include paper milk cartons, 12 and 16 ounce glass bottles, 2 liter plastic bottles, and other such containers.

Bottled beverages typically come in either plastic or glass bottles with metal or plastic closures sealing the beverage therein until the time for consumption. These containers typically include a narrowing neck with a fluid access opening therein. A number of closures have been used to cover this fluid access opening including metal lids requiring a bottle opener to remove, twist off metal lids, snap on-off plastic caps, screw on-off plastic caps, and pull up and push down type caps. These caps all serve to provide access to the fluid contained within the container. The closure is preferably reusable in that it may be removed from and replaced onto the container thereby allowing only a portion of the fluid contained within the container to be used at a given sitting.

The need for closure of these containers is historically based upon a number of concerns including spillage, spoilage, evaporation, and contamination of the fluid contained within the container. More recent designs continue to take into account these historical needs as well as today's desired qualities such as ease and speed of use, and retention of carbonation.

However, one disadvantage of these closures is the requirement that the closure be completely removed to gain access to the container. Complete removal of the closure creates a risk that the closure will be misplaced or dropped.

SUMMARY OF THE INVENTION

Objectives of the invention include providing a container closure for providing access to the fluid contents of a container without the necessity of completely removing the entire closure and thereby subjecting the closure to loss or damage, and the fluid contents of the container to spillage, spoilage, evaporation, and contamination.

A further objective of the invention is to provide a two part closure connected together by a flexible hinge.

Still a further objective of the invention includes providing a closure which is only partially removed to allow access to the fluid within a container.

Another objective of the invention is to provide a closure which, when fully tightened down, seals off the fluid access opening thereby assuring continued quality of the beverage within the container.

A still further objective of the invention is to provide a closure with a position indicator to indicate that sufficient twisting has occurred to disengage the cap portion from the container while the sleeve portion continues to engage the container.

Yet a further objective of the invention is to provide a position indicator which also acts as a catch that tends to restrict rotation of the closure with reference to the threaded nozzle.

Yet another objective is to provide a closure which will thread onto an existing container.

Still another objective is to provide a closure which is of simple construction, which achieves the stated objectives in a simple, effective and inexpensive manner, and which solves problems and satisfies needs existing in the art.

These and other objectives and advantages of the invention are obtained by the improved closure, the general nature of which may be stated as including a first portion removably threadable to the nozzle of the container; a second portion removably threadable to the nozzle of the container; and a flexible hinge connecting the first portion to the second portion.

BRIEF DESCRIPTION OF THE DRAWINGS

The preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
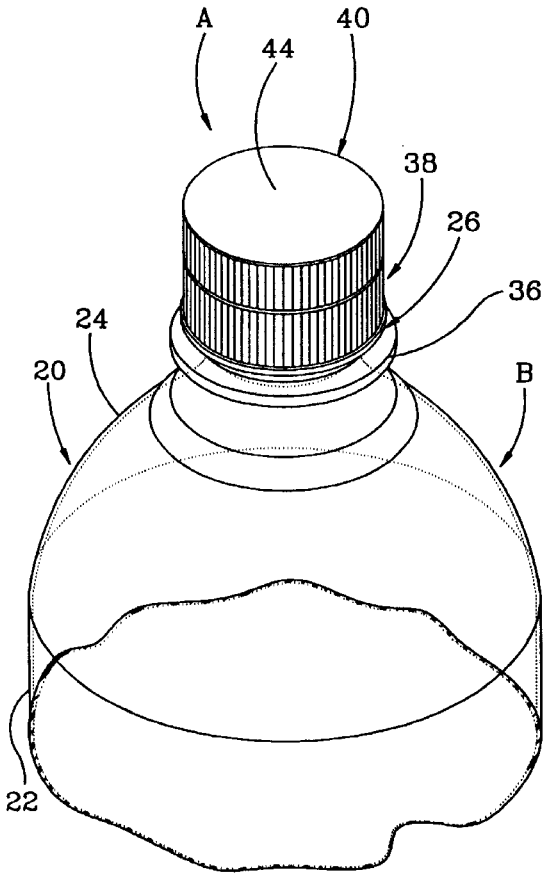
FIG. 1 is a perspective view of the first embodiment of a closure assembly attached to a container (partially cut away and in the form of a 2-liter bottle) where the closure assembly is in a closed position.
Figure 2:
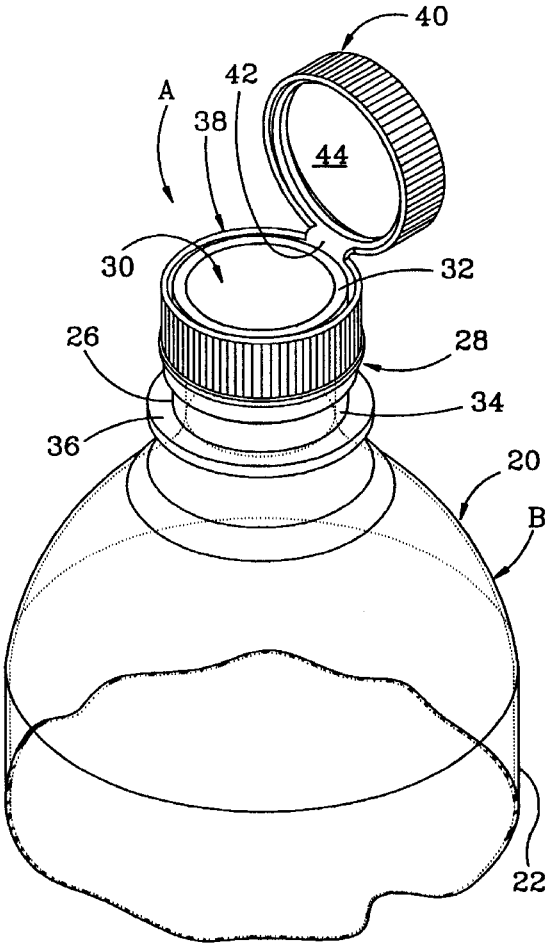
FIG. 2 is a perspective view of the closure assembly and container of FIG. 1 except that the closure assembly is in a partially threaded position and a cap portion of the closure is pivoted from the closed position to an open position.
Figure 3:
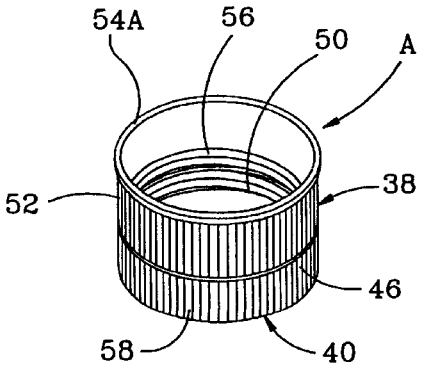
FIG. 3 is a perspective view of the closure assembly in the closed position.
Figure 4:
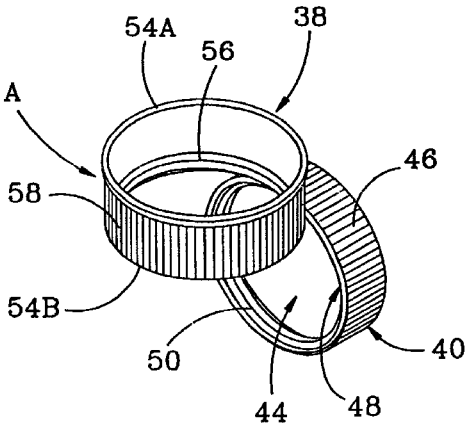
FIG. 4 is a perspective view of the closure assembly similar to FIG. 3 in the open position.

The improved bottle closure assembly is indicated generally at A in its intended environment as a closure for a container B and is shown generally in FIGS. 1 and 2.

As illustrated in FIGS. 1 and 2, the container B is a bottle 20 comprising a main body 22, a neck 24, and a nozzle 26. The main body 22 is the fluid storage cavity. The neck 24 is an inverted funnel-shaped or dome-shaped portion connecting the main body 22 to the nozzle 26. The nozzle 26 includes an externally threaded cylindrical portion 28.

As is shown in FIG. 2, the top of the nozzle 26 has a hole 30 that functions as a fluid access port through which all fluid enters and exits the container B. Around the hole 30 is a lip or edge 32 upon which the closure A seats or rests when fully threaded onto the nozzle 26. The combination of the thread interaction between the closure A and the nozzle 26, and the seating or resting of the closure A on the lip 32 results in a seal for preventing leaking of the fluid from within the container. Nozzle 26 also includes an unthreaded portion 34 and a flange 36. Bottle 20 is made from a polymeric compound, although it can be made from any material, such as glass without departing from the spirit of the present invention. In the preferred embodiment, the bottle is a plastic extrusion blow molded container such as a 2-liter bottle.

The closure A, as is illustrated in FIGS. 1–4 comprises a sleeve portion 38 and a cap portion 40 pivotally connected together by a hinge 42. The cap portion 40 includes a closed top 44 against which the top edge or lip 32 of the nozzle 26 abuts when the closure A is fully threaded onto the nozzle 26.

In accordance with one of the main features of the present invention, the cap portion 40 is defined by a cylindrical side wall 46 and two circular ends. One end is open and has a circular face 48 of approximately the same thickness as the cylindrical side wall 46. The other end is closed by circular top 44. The cylindrical side wall 46 extends transversely away from the circular top 44. The cylindrical side wall 46 and circular top 44 define a cavity in the cap portion 40. The inner surface of the cylindrical side wall 46 in the cavity has circumferential threads 50 thereon that are complimentary to the external threads on the nozzle 26 thereby allowing the cap portion 40 to be threaded completely onto the externally threaded portion 28 of the nozzle 26.

The sleeve portion 38 is defined by a cylindrical side wall 52 with a top and a bottom open end. Each open end has a circular face 54A and 54B, respectively. The sleeve portion 38 is shaped and functions as a cylindrical extension of the cap portion 40. The sleeve portion 38 is also axially alignable with the cap portion 40 when the cap portion is closed against the sleeve portion. The sleeve portion 38 is of the same cross-sectional size and shape as the cap portion 40. The cylindrical side wall 52 defines a through-bore in the sleeve portion 38. The inner surface of the cylindrical side wall 52 in the through-bore has circumferential threads 56 thereon that are complimentary to the external threads on the nozzle 26. The circumferential threads 56 are also alignable with the circumferential threads 50 of the cap portion 40 so that when the cap portion 40 is closed against the sleeve portion 38 the external threads on the nozzle 26 can mate with both threads 50 and 56 thereby allowing the cap portion 40 and the sleeve portion 38 to be threaded completely onto the externally threaded portion 28 of the nozzle 26.

The external arcuate surface of both the sleeve portion 38 and the cap portion 40 is ribbed with longitudinal ribs 58. These ribs provide a better surface for gripping when tightening or loosening the cap portion 40 from the nozzle 26.

The closure A is made from a polymeric compound, although it can be made from any material without departing from the spirit of the present invention. In the preferred embodiment, the closure A is a molded plastic closure. The closure can be molded as a three part (cap, hinge, and sleeve) closure, or it can be molded as a one part cap and partially cross-sectionally cut thereby forming a cap and sleeve portion with a connecting hinge.

The use of the closure A and the container B involves three general closure positions or ranges with reference to the nozzle 26: a fully or substantially fully threaded position, a partially threaded position, and a completely unthreaded position. The results of these various positions are a sealed container, a fluid accessible container where the cap portion is movable from a closed to an open position, and a completely open (uncapped) container, respectively.

The closure A is shown in FIG. 1 in a fully threaded position where the lip 32 (hidden within the cap portion) abuts or nearly abuts the top 44. When the closure A is in this fully threaded position, the cap portion 40 is fixed to the closure 26 based upon the interengagement of the internal threads of the cap with the external threads of the nozzle 26. The result is that the cap portion is not pivotable about the hinge 42 thereby prohibiting access to the fluid within the container B via the hole 30.

The closure A is shown in FIG. 2 in a partially threaded position where only the sleeve portion 38 is threaded onto the threaded nozzle 26 and the threads of the cap portion no longer engage the nozzle 26. The result of this partial threading is that the cap portion 40 is pivotable about the hinge 42. FIG. 2 shows the cap portion 40 of the closure A after it has been pivoted to an open position from the closed position. This open position allows access to the fluid within the container B for removal (or addition) of fluid such as by pouring into a glass.

Although not shown in FIGS. 1 or 2, the closure A is also completely removable from the nozzle 26. This occurs by completely unthreading the closure A from the nozzle 26. This allows reuse of the closure A on another container after the fluids within container B have been fully depleted.

FIGS. 5–13 disclose an alternative embodiment for the container and the closure. Closure A' and container B' are substantially identical to closure A and container B except that both closure A' and container B' include one or more protuberances that extend into the interaction area where the threads 50 and 56, and corresponding adjacent surfaces of the sleeve portion 38 and the cap portion 40 interact.

Figure 7:
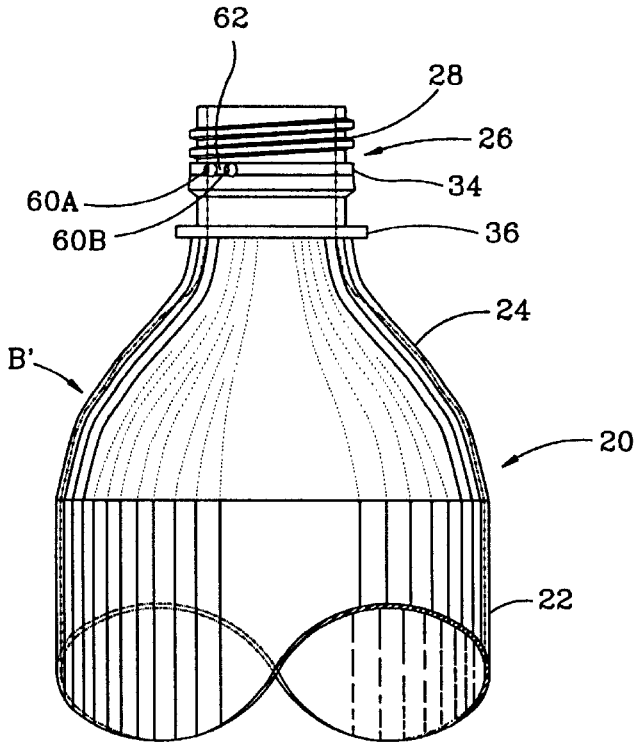
FIG. 7 is a side perspective view of the second embodiment of a container having two protuberances on the neck portion of the container.
Figure 8:
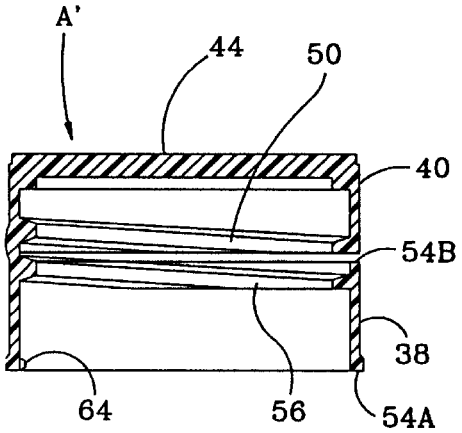
FIG. 8 is a sectional view of the second embodiment of the invention taken along line 8—8, FIG. 5.
Figure 5:
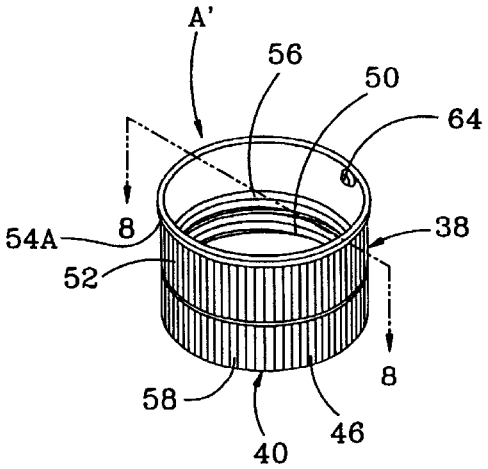
FIG. 5 is a perspective view of a second embodiment of the invention, shown in the closed position.
Figure 6:
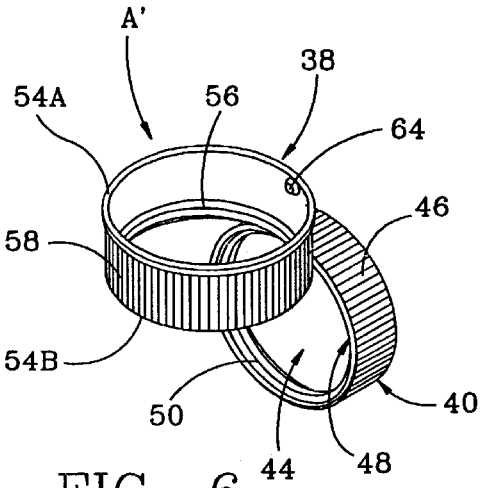
FIG. 6 is a perspective view similar to FIG. 5 of the closure assembly of the second embodiment of the invention, shown in the closed position.

In the second embodiment, the nozzle 26 as is shown in FIG. 7 includes a pair of protuberances 60A and 60B with a small gap 62 therebetween. Each of these protuberances 60A and 60B are small nubs protruding outward from the external surface of the nozzle 26. Preferably, the protuberances 60A and 60B protrude outward from the unthreaded portion 34 of the nozzle 26.

In accordance with one of the main features of the second embodiment, the closure A' has a single protuberance 64. This protuberance may be located at any position on the inside facing of the sleeve portion 38 or the cap portion 40, although this protuberance must be located in a position on this inside facing that corresponds at the proper cap release time with the location of the pair of protuberances on the nozzle 26. Typically, the protuberance 64 is located near the circular face 54A thereby corresponding to the pair of protuberances 60A and 60B which preferably protrude from the unthreaded portion 34.

All of the protuberances 60A, 60B, and 64 are arcuate in shape, such as rounded or conical, thereby providing a smooth, curving surface with a central peak for a corresponding protuberance interactively positioned in approximately tangential relation on an adjacent rotating surface to ride up and over with minimal yet accountable resistance. The result of this curving surface and the interactive positioning which provides some resistance is that the closure A' is freely rotatable on the threaded nozzle 26 until the protuberance 64 on the closure meets one of the protuberances 60A and 60B on the nozzle whereby additional twisting action is required to overcome the resistance of the two interacting protuberances 64 and 60A, or 64 and 60B. This additional twisting overcomes the resistance and pops the protuberance 64 up and over one of the protuberances 60A or 60B and positions protuberance 64 in the gap 62. Any continued twisting will overcome the second protuberance and allow the closure to completely be removed from the nozzle 26.

Specifically, the pair of protuberances 60A and 60B act as a locking area whereby when the single protuberance 64 of the closure is in the gap 62 between the protuberances 60A and 60B, the closure is restricted from free rotation due to the confinement of the single protuberance 64 between the close proximity protuberances 60A and 60B.

Figure 9:
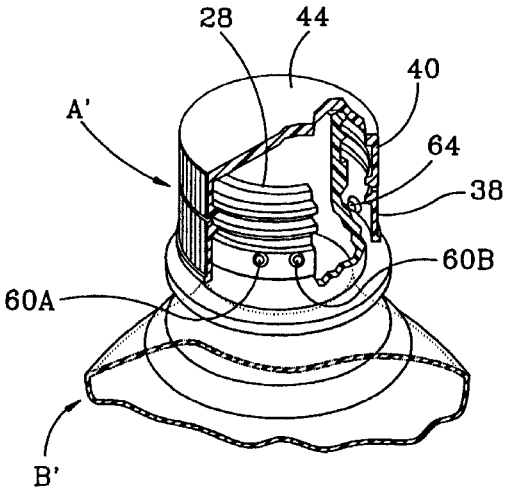
FIG. 9 is a perspective view of the second embodiment with portions broken away and in section and shown in a first position.
Figure 11:
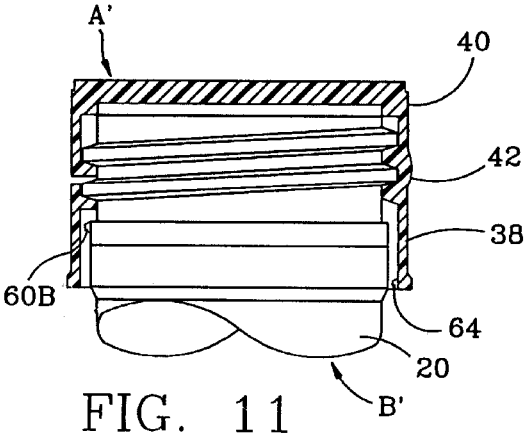
FIG. 11 is a sectional view of the closure assembly and a portion of the container as shown in FIG. 9.
Figure 13:
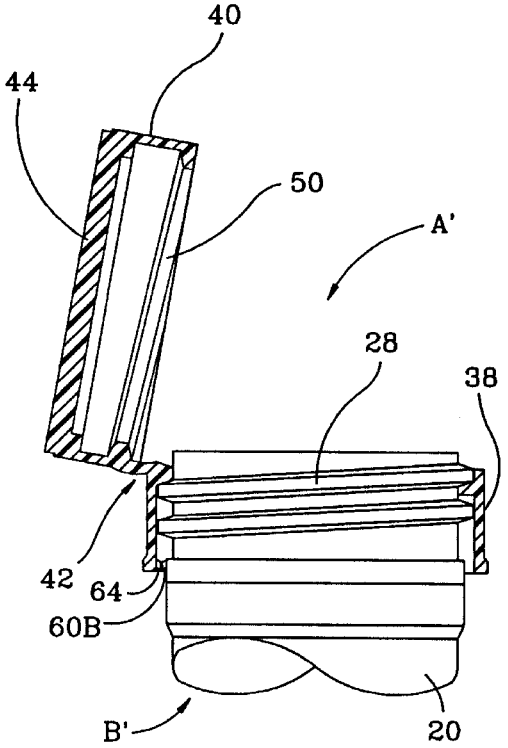
FIG. 13 is a sectional view of the closure assembly and a portion of the container as is shown in FIG. 10 with the cap portion in the open position.

FIGS. 9 and 11 show the closure A'-nozzle 26 interaction when the single protuberance 64 of the closure is in a first range of positions described with respect to the first embodiment of the invention (i.e., either fully threaded or partially threaded sufficiently that the cap portion is threaded onto the nozzle, and thus the single protuberance is not confined between the pair of protuberances 60A and 60B). The closure A' is freely rotatable about the threads on nozzle 26 within this first range of positions which specifically extends from a first cap-locked position where the closure has sealed hole 30 in the top of the container B' and the closure is fully threaded onto nozzle 26, to a second cap-locked position where the single protuberance 64 of the closure is adjacent protuberance 60A of the pair of protuberances 60A and 60B, and just outside the gap 62 in between the pair of protuberances 60A and 60B. As specifically shown in FIG. 11, the internal threads of both the cap portion and the sleeve portion engage the threads of nozzle 26.

Figure 10:
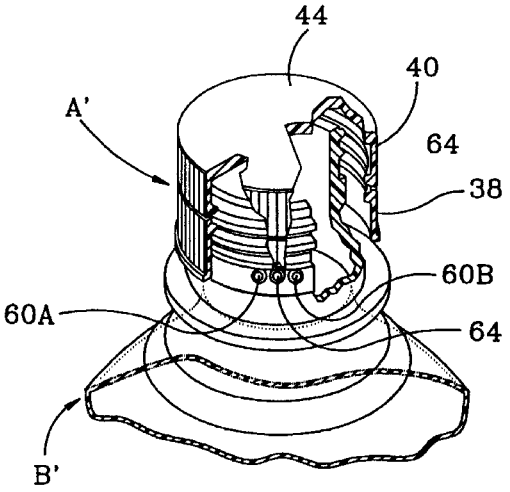
FIG. 10 is similar to FIG. 9 with the closure assembly shown in a second position.
Figure 12:
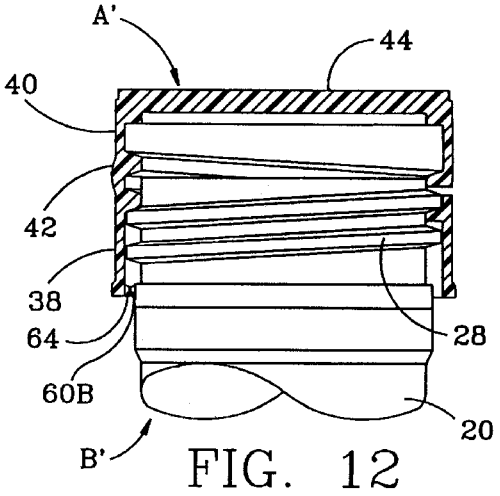
FIG. 12 is a sectional view of the closure assembly and a portion of the container as shown in FIG. 10.

In contrast, FIGS. 10 and 12 show the closure A'-nozzle 26 interaction when the single protuberance 64 of the closure is confined in the gap 62 between the pair of protuberances 60A and 60B. The closure A' is confined in this gap absent additional twisting action to overcome the resistance of the one of the two interacting protuberances 64 and 60A, or 64 and 60B and escape the gap.

The purpose of snapping the single protuberance 64 in between the pair of protuberances 60A and 60B is to indicate that the closure is properly positioned for the opening of the container B'. Specifically, the indication of proper positioning signifies that the cap portion 40 is properly positioned to be pivoted about the hinge 42 and away from the sleeve portion 40 to provide access to the hole 30 in the top of the container. In contrast, if the protuberance 64 is not in the gap, but still in the first range, i.e., not properly aligned in between the pair of protuberances, then the cap portion 38 cannot be removed from the nozzle 26 because the threads of each are at least partially still engaged.

The closure A' and the container B' may also be positioned in a second range of positions. If an additional twisting action is supplied to overcome the resistance of the pair of protuberances 60A and 60B, then the single protuberance snaps out the gap and into a second range. The closure A' is freely rotatable about the threads on nozzle 26 within this second range of positions which extends from a first cap-unlocked position where the single protuberance 64 of the closure is adjacent protuberance 60B of the pair of protuberances 60A and 60B and just outside the gap 62 in between the pair of protuberances 60A and 60B, to a second cap-unlocked position where the closure A' is completely removable from the nozzle 26.

The closure A' may be threaded back onto the nozzle 26 in a manner similar but reversed of the above described removal process. The closure A' is reusable and therefore may be removed from and re-threaded onto a container over and over.

In sum, the invention is a closure A or cap for a container B such as a bottle having external threads 28 on a nozzle portion 26. The cap A includes a lower or sleeve portion 38 and an upper or cap portion 40. The sleeve portion 38 and the cap portion 40 are hingedly connected at living hinge 42. The sleeve portion 38 includes internal circumferential threads 56 on at least a portion of the cylindrical side wall 52 that are complementarily related to the threads 28 on the nozzle for retaining the sleeve portion to the nozzle. Similarly, the cap portion 40 includes internal circumferential threads 50 on the cylindrical side wall 46 for retaining the cap portion to the nozzle.

When the closure is rotated to the fully threaded position, i.e., fully tightened down on the nozzle, the threads 50 and 56 of the cap and sleeve portions 40 and 38 engage the threads 28 of the nozzle 26 to lock the cap portion 40 in a closed position. However, when the closure is rotated, the threads 50 within the cap portion 40 disengage from the threads 28 of the nozzle 26 such that the hinge 42 may be actuated to open the cap portion 40 thereby allowing access to the fluid within the container B.

The invention may also be embodied with protuberances or nubs 60A and 60B on the nozzle, and 64 on the sleeve portion, for restricting rotation (twisting) of the closure absent some additional force to overcome the resistance provided by the interaction of protuberance 64 with either protuberance 60A or 60B. This resistance indicates that the closure is properly positioned for the pivoting of the cap portion thereby providing access to the fluid within the container.

Accordingly, the improved bottle closure apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved bottle closure apparatus is constructed and used, the characteristics of the construction, and the advantageous, new and useful results obtained; the new and useful structures, devices, elements, arrangements, parts and combinations, are set forth in the appended claims.

I claim:

1. A closure and container assembly for re-sealable access to the container without complete closure removal, said closure and container assembly comprising:

a container having an externally threaded neck with an access port formed therein;

a fluid access port closure having a cap portion and a sleeve portion separated by a substantially circumferential gap and connected by a hinge, the cap and sleeve portions each having threads to operatively engage the externally threaded neck thereby defining a fully threaded position where the threads of both the cap and sleeve portions at least minimally engage the externally threaded neck, a partially threaded position where only the threads of the sleeve portion at least minimally engage the threaded neck, and a removed position where none of the threads engage any of the threaded neck;

the cap portion and sleeve portion having the same direction threads whereby when said cap portion is in the partially threaded position, said cap portion disengages the threaded neck of the container prior to the sleeve portion disengaging the threaded neck to permit the cap portion to pivot on the hinge while the sleeve remains threaded onto the threaded neck; and a position indicator for indicating the position of the cap portion with reference to the neck of the container; the position indicator including first and second protuberances protruding outwardly form the neck, the first and second protuberances being separated by a gap; a position indicator further including an inwardly extending third protuberance disposed on the sleeve portion; the protuberances arranged to define a first range of positions where the fluid access port closure is disposed between the fully threaded position and where the third protuberance is adjacent the first protuberance; a second position where the third protuberance is disposed in the gap between the first and second protuberances; and a second range of positions where the third protuberance is adjacent to the second protuberance to where the third protuberance disengages the neck; the positions allowing the user to readily identify the position of the fluid access port closure with respect to the neck.

2. The assembly as set forth in claim 1 in which the cap portion comprises an end cap having circumferential threads formed thereon.

3. The assembly as set forth in claim 2 in which the cap portion comprises a circular top and a cylindrical side wall extending transversely therefrom; and in which the circumferential threads are formed on the cylindrical side wall.

4. The assembly as set forth in claim 3 in which the sleeve portion has circumferential threads formed thereon and, in which the sleeve portion has substantially the same cross-sectional size as the cap portion.

5. The assembly as set forth in claim 1 in which both the cap portion and the sleeve portion include an outer ribbed surface.

6. A closure and container assembly for re-sealable access to the container without complete closure removal, said closure and container assembly comprising;

a container having an externally threaded neck with an access port formed therein;

a fluid access port closure that has been partially cross-sectionally cut to form a cap portion and a sleeve portion connected by a living hinge, the cap and sleeve portions each having threads to operatively engage the externally threaded neck thereby defining a fully threaded position where the threads of both the cap and sleeve portions at least minimally engage the externally threaded neck, a partially threaded position where only the threads of the sleeve portion at least minimally engage the threaded neck, and a removed position where none of the threads engage any of the threaded neck;

the cap portion and sleeve portion having the same direction threads whereby when said cap portion is in the partially threaded position, said cap portion disengages that threaded neck of the container prior to the sleeve portion disengaging the threaded neck to permit the cap portion to pivot on the hinge while the sleeve remains threaded onto the threaded neck; and a position indicator for indicating the position of the cap portion with reference to the neck of the container; the position indicator including first and second protuberances protruding outwardly from the neck, the first and second protuberances being separated by a gap; a position indicator further including an inwardly extending third protuberance disposed on the sleeve portion; the protuberances arranged to define a first range of positions where the fluid access port closure is disposed between the fully threaded position and where the third protuberance is adjacent the first protuberance; a second position where the third protuberance is disposed in the gap between the first and second protuberances; and a second range of positions where the third protuberance is adjacent to the second protuberance to where the third protuberance disengages the neck; the positions allowing the user to readily identify the position of the fluid access port closure with respect to the neck.

* * * * *